United States Patent [19]

Schillinger et al.

[11] Patent Number: 4,635,738

[45] Date of Patent: Jan. 13, 1987

[54] DRILL BIT

[75] Inventors: Hans Schillinger, Celle; Klaus Pahlke, Ovelgonne; Siegfried Starke, Grob Ilsede; Heinz-Juergen Panhorst, Nienhagen; Hans-Eckhard Mengel, Celle, all of Fed. Rep. of Germany

[73] Assignee: Norton Christensen, Inc., Salt Lake City, Utah

[21] Appl. No.: 720,237

[22] Filed: Apr. 5, 1985

[30] Foreign Application Priority Data

Apr. 14, 1984 [DE] Fed. Rep. of Germany ..... 8411809

[51] Int. Cl.[4] ..... E21B 10/00

[52] U.S. Cl. ..... 175/398

[58] Field of Search ..... 175/398, 399, 400, 258, 175/376, 350, 353

[56] References Cited

U.S. PATENT DOCUMENTS

| | | | |
|---|---|---|---|
| 2,802,642 | 8/1957 | Feucht | 175/400 |
| 2,953,354 | 9/1960 | Williams, Jr. | 175/329 |
| 3,159,224 | 12/1964 | Cleary | 175/399 X |
| 3,191,698 | 6/1965 | Short | 175/400 X |
| 3,924,698 | 12/1975 | Juvkam-Wold | 175/400 X |
| 4,440,244 | 4/1984 | Wiredal | 175/398 X |

FOREIGN PATENT DOCUMENTS

| | | | |
|---|---|---|---|
| 918741 | 10/1954 | Fed. Rep. of Germany | 175/398 |
| 387097 | 6/1908 | France | 175/398 |
| 1050116 | 12/1966 | United Kingdom | 175/398 |

*Primary Examiner*—Stephen J. Novosad
*Assistant Examiner*—David J. Bagnell
*Attorney, Agent, or Firm*—Rufus M. Franklin

[57] ABSTRACT

A drill bit for drilling bore holes in underground formations comprising a bit body with a connecting spigot for connecting to a drill string or the like, and a cutting head which comprises a circumferential face extending parallel to its longitudinal axis and an end face having a drilling axis which is aligned with the axis of the connecting spigot. The drilling axis is parallel to and is offset relative to the axis of the cutting head. It is preferred that the end face is, at least in part, conical in shape.

1 Claim, 1 Drawing Figure

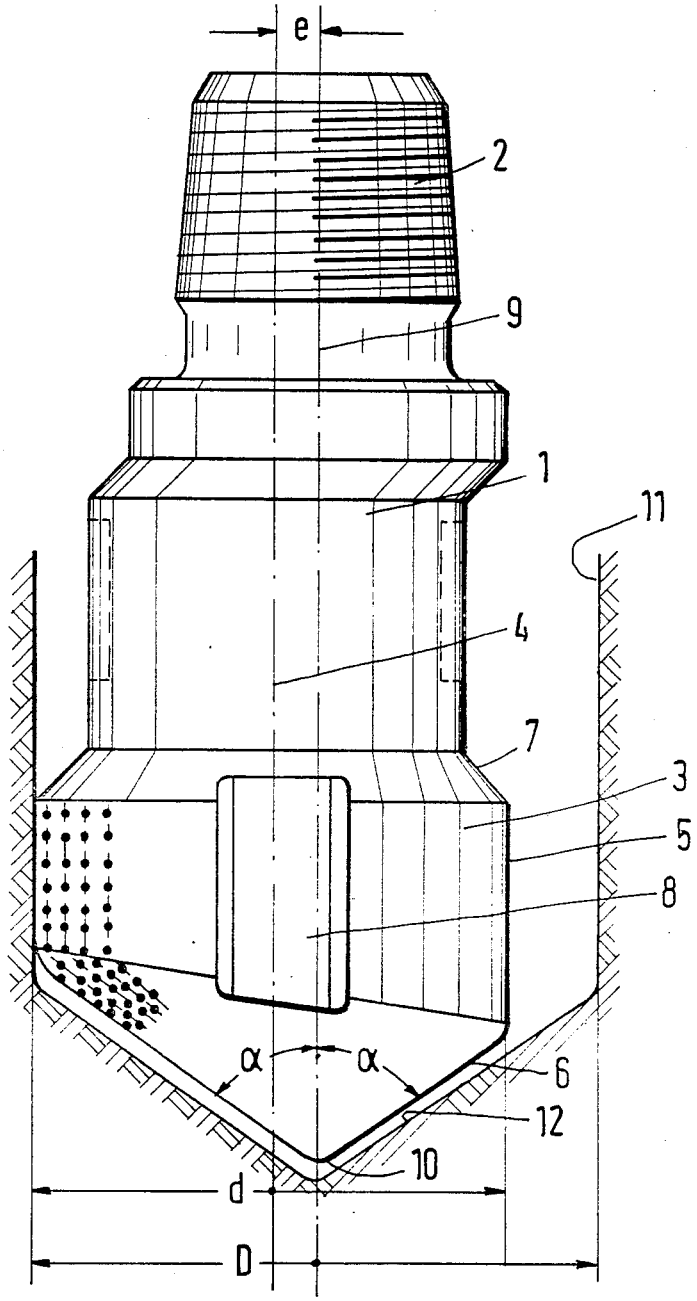
e
2
9
1
11
4
7
3
5
8
α
α
6
12
10
d
D

DRILL BIT

BACKGROUND OF THE INVENTION

1. Field of the Invention

This invention relates to drill bits and more particularly concerns drill bits for use in drilling bore holes in underground formations.

2. Description of Prior Art

U.S. Pat. No. 2,953,354 describes a drill bit for drilling bore holes into earth formations. The drill bit includes a cutting head which has a circumferential cutting face and an end cutting face both having an axis which is spaced from the axis of rotation of the drill bit during drilling. This arrangement produces an eccentric rotation of the cutting head so that the bore-hole produced is larger in diameter than the diameter of the cutting head.

This arrangement has the advantage that it can be withdrawn from a bore-hole without damaging the cutting faces and can also be used for increasing the depth of an existing bore-hole or for reaming an existing bore-hole without damaging the cutting faces.

The application of this type of drill bit is limited however because it requires a drill core to centre and guide it during drilling operations. If the drill core breaks, if there is a pilot hole or if the underground formation being drilled is not sufficiently firm the drill bit will tend to rotate about its own axis so that the bore-hole will be the same diameter as the cutting head of the drill bit.

It is an object of the present invention to provide an improved drill bit for drilling bore holes in underground formations. It is a further object of the invention to provide a drill bit which is capable of drilling a bore hole of a diameter larger than the diameter of the drill bit and which has improved centring reliability.

SUMMARY OF THE INVENTION

According to the present invention we provide a drill bit for drilling bore holes comprising a connecting spigot for connecting to a drill string, said spigot having a longitudinal axis of rotation, a cutting head having a longitudinal axis, said cutting head comprising a circumferential face having an axis which is substantially coincident with the cutting head axis and an end face projecting away from said spigot and having a drilling axis, said drilling axis of the end face of the cutting head being substantially aligned with the axis of rotation of the spigot and said cutting head axis being spaced from and substantially parallel to the axis of rotation of the spigot.

Preferably the end face of the cutting head is at least partially conical in shape.

Advantageously the circumferential face has a first surface portion radially more remote from the axis of rotation of the spigot and a second surface portion radially nearer said axis, the first surface being relatively more wear-resistant than the second surface.

The drill bit of the invention has an end face projecting away from the spigot and has a drilling axis which is aligned with the axis of rotation of the spigot. Thus the drill bit tends to centre itself relative to the drilling axis, especially when the end face is conical in shape. The positioning of the cutting head axis spaced from the axis of rotation provides an eccentric drilling action whereby a bore hole having a diameter larger than that of the cutting head is achieved.

The drill bit is effective in soft or frangible underground formations and can also be used in pilot holes provided that the pilot hole radius is shorter than the shortest distance between the circumferential face and the drilling axis.

BRIEF DESCRIPTION OF THE DRAWING

Reference is now made to the accompanying drawings, in which the single FIGURE is a side elevation of a preferred embodiment of the invention.

The rotary drill bit consists of a drill bit body 1, a connecting spigot 2 for connecting to a drill string (not shown), and a cutting head 3. The cutting head 3 comprises a circumferential face 5 extending parallel to its longitudinal centre axis 4 and an end face 6 continuing from the circumferential face 5 into a central area. The circumferential face 5 is a roughly cylindrical envelope which projects radially relative to the bit body 1 and merges via a chamfer 7 into the smaller diameter of the bit body 1. The diameter defined by the envelope of the circumferential face 5 is designated as d.

The surface of the circumferential face 5 is interrupted by a plurality of longitudinally extending grooves 8 which permit the free passage of drilling fluid and cuttings.

The end face 6 of the cutting head 3 is conical and projects in the direction of drilling. The drilling axis 9 of the cone is parallel to and offset from the longitudinal centre axis 4 of the cutting head 3 which is aligned with the longitudinal axis of the connecting spigot 2. The amount of offset is indicated by the eccentricity e.

The conical surface of the end end face 6 defines an angle $\alpha$ with the drilling axis 9 of the cone. Usually the angle $\alpha$ will be between 30° and 60° depending upon the nature of the underground formation being drilled. In harder rock formations the angle $\alpha$ is preferably about 55° as shown in the drawing. In particularly soft formations it is advantageous to reduce the 55° angle shown in the drawing so that a larger centring area for the drill bit can be presented.

During drilling the drill bit is rotated about the axis of the spigot and the drilling axis 9 of the cone so that the side of the circumferential area 5 furthest away from the drilling axis 9 describes an envelope of diameter D. This diameter D is larger by double the eccentricity e than the diameter d of the envelope of the circumferential area 5.

The bore hole 11 is thus drilled with an inside diameter D, because the drill bit is centred on its rotational axis by the cone point 10 about the drilling axis 9 when it is placed on the bore hole bottom 12. During a stationary drilling operation, the entire end face 6 of the cutting head 3 engages with the bore hole bottom 12 and thus helps to centre the drill bit. Moreover, the drill bit can also be centered if an existing pilot hole is to be drilled out to a large diameter, provided the radius of the pilot hole is smaller than the shortest distance of the circumferential face 5 of the cutting head 3 to the drilling axis 9.

If the drill bit is to be used only for drilling out pilot holes the part of the end face 6 directly in the area of the drilling axis 9 does not need to be provided with cutting material and can be of a shape other than conical. It is sufficient for only the part of the end face 6 which engages with the underground formation and adjoins the circumferential face 5 to be conical. Reduction of the amount of cutting material provided reduces the cost of the drill bit.

Depending on the formation which is to be drilled, all known types of cutting material can be employed. These include diamond coatings with impregnated diamonds or diamonds set in the surface, discrete cutting elements or cutting elements arranged in rows with synthetic or natural diamonds in known configurations, and other wear-resistant cutting elements.

The drilling fluid supply can be such as to meet the requirement of the cutting elements selected.

The portion of the circumferential face 5 which is furthest away from the drilling axis 9 and stressed to a particularly high degree can be provided with a more wear-resistant layer than the opposite side of the circumference face 5.

We claim:

1. A drill bit for drilling bore holes comprising a connecting spigot for connecting to a drill string, said spigot having a longitudinal axis of rotation, a cutting head having a longitudinal axis, eccentric of the spigot axis said cutting head comprising a circumferential face having an axis which is substantially coincident with the cutting head axis and an end face projecting away from said spigot, said end face being substantially conical and coaxial with the axis of rotation of said spigot, said conical end face terminating at a point axially opposite said spigot.

* * * * *